US008154218B2

(12) United States Patent
Gordin et al.

(10) Patent No.: US 8,154,218 B2
(45) Date of Patent: Apr. 10, 2012

(54) METHOD AND APPARATUS FOR RETROFITTING HID LAMPS WITH SYSTEM TO PERIODICALLY ADJUST OPERATING WATTAGE

(75) Inventors: Myron Gordin, Oskaloosa, IA (US); Timothy J. Boyle, Oskaloosa, IA (US)

(73) Assignee: Musco Corporation, Oskaloosa, IA (US)

( * ) Notice: Subject to any disclaimer, the term of this patent is extended or adjusted under 35 U.S.C. 154(b) by 0 days.

(21) Appl. No.: 12/905,694

(22) Filed: Oct. 15, 2010

(65) Prior Publication Data

US 2011/0025231 A1 Feb. 3, 2011

Related U.S. Application Data

(63) Continuation of application No. 11/334,686, filed on Jan. 18, 2006, now Pat. No. 7,843,144, which is a continuation-in-part of application No. 10/785,867, filed on Feb. 24, 2004, now Pat. No. 7,176,635.

(60) Provisional application No. 60/644,546, filed on Jan. 18, 2005.

(51) Int. Cl.
*G05F 1/00* (2006.01)

(52) U.S. Cl. ..... 315/291; 315/185 S; 315/224; 315/307; 315/312

(58) Field of Classification Search ..... 315/291, 315/224, 225, 247, 246, 209 R, 307, 312, 315/324, 326, 185 S
See application file for complete search history.

(56) References Cited

U.S. PATENT DOCUMENTS

| | | | |
|---|---|---|---|
| 2,447,923 | A | 8/1948 | Tuck |
| 4,005,336 | A | 1/1977 | Casella |
| 4,009,387 | A | 2/1977 | Nuver |
| 4,189,664 | A | 2/1980 | Hirschfeld |
| 4,292,570 | A | 9/1981 | Engel |
| 4,434,388 | A | 2/1984 | Carver et al. |
| 4,442,382 | A | 4/1984 | Fleck |
| 4,475,065 | A | 10/1984 | Bhalla et al. |
| 4,501,994 | A | 2/1985 | Spreadbury |
| 4,725,934 | A | 2/1988 | Gordin |
| 4,891,562 | A | 1/1990 | Nuckolls et al. |
| 4,924,109 | A | 5/1990 | Weber |
| 4,994,718 | A | 2/1991 | Gordin |
| 5,075,828 | A | 12/1991 | Gordin et al. |
| 5,103,143 | A | 4/1992 | Daub |
| 5,134,557 | A | 7/1992 | Gordin et al. |
| 5,161,883 | A | 11/1992 | Gordin et al. |
| 5,442,261 | A | 8/1995 | Bank et al. |
| 5,469,027 | A | 11/1995 | Uchihashi et al. |
| 5,475,360 | A | 12/1995 | Guidette et al. |

(Continued)

FOREIGN PATENT DOCUMENTS

DE 195 40 326 A1 4/1997

(Continued)

*Primary Examiner* — Tuyet Thi Vo
(74) *Attorney, Agent, or Firm* — McKee, Voorhees & Sease, P.L.C.

(57) ABSTRACT

A method, apparatus, and system for increasing usable light from a high intensity lighting fixture to a target area without an increase in energy use. In one aspect, the circuit is retrofitted into an existing lamp circuit that allows selective change in operating power or wattage to the lamp, over a substantial period of operation time, to save energy. In one aspect operating wattage of the lamp would be reduced. In another aspect of the invention, reduction in operating wattage is accomplished by a switchable capacitance in electrical communication with the lamp circuit.

17 Claims, 5 Drawing Sheets

U.S. PATENT DOCUMENTS

| | | | | |
|---|---|---|---|---|
| 5,519,286 | A | 5/1996 | Rodrigues et al. | |
| 6,075,326 | A | 6/2000 | Nostwick | |
| 6,150,772 | A | 11/2000 | Crane | |
| 6,157,143 | A | 12/2000 | Bigio et al. | |
| 6,191,568 | B1 | 2/2001 | Poletti | |
| 6,203,176 | B1 | 3/2001 | Gordin | |
| 6,207,943 | B1 | 3/2001 | Smelker | |
| 6,215,254 | B1 | 4/2001 | Honda et al. | |
| 6,320,323 | B1 | 11/2001 | Buell et al. | |
| 6,373,201 | B2 | 4/2002 | Morgan et al. | |
| 6,376,996 | B1 | 4/2002 | Olson | |
| 6,501,231 | B1 | 12/2002 | Hyland et al. | |
| 6,515,430 | B2 | 2/2003 | Kayser | |
| 6,545,433 | B2 | 4/2003 | Beij et al. | |
| 6,577,075 | B2 | 6/2003 | Romano et al. | |
| 6,583,574 | B2 | 6/2003 | Ann et al. | |
| 6,685,339 | B2 * | 2/2004 | Daughtry et al. | 362/249.05 |
| 6,756,893 | B1 * | 6/2004 | Fernandez | 340/458 |
| 2003/0025463 | A1 | 2/2003 | Mattas | |
| 2003/0090215 | A1 | 5/2003 | Beasley | |
| 2005/0184681 | A1 | 8/2005 | Gordin et al. | |
| 2006/0066261 | A1 | 3/2006 | Rahmane et al. | |
| 2007/0153524 | A1 * | 7/2007 | Lee | 362/276 |

FOREIGN PATENT DOCUMENTS

| | | | |
|---|---|---|---|
| DE | 199 12 517 | A1 | 9/2000 |
| EP | 0 536 877 | A1 | 4/1993 |
| EP | 1 172 938 | A2 | 1/2002 |
| JP | 406163163 | A | 6/1994 |

* cited by examiner

METHOD AND APPARATUS FOR RETROFITTING HID LAMPS WITH SYSTEM TO PERIODICALLY ADJUST OPERATING WATTAGE

CROSS REFERENCE TO RELATED APPLICATIONS

This is a continuation application of U.S. Ser. No. 11/334,686, filed Jan. 18, 2006, issued as U.S. Pat. No. 7,843,144 on Nov. 30, 2010, which is a continuation-in-part of U.S. Ser. No. 10/785,867, filed Feb. 24, 2004, issued as U.S. Pat. No. 7,176,635 on Feb. 13, 2007, and also claims priority of a provisional application U.S. Ser. No. 60/644,546, filed Jan. 18, 2005, herein incorporated by reference in its entirety.

This application is also a non-provisional of the following provisional U.S. applications, all filed Jan. 18, 2005: U.S. Ser. No. 60/644,639; U.S. Ser. No. 60/644,536; U.S. Ser. No. 60/644,747; U.S. Ser. No. 60/644,534; U.S. Ser. No. 60/644,720; U.S. Ser. No. 60/644,688; U.S. Ser. No. 60/644,636; U.S. Ser. No. 60/644,517; U.S. Ser. No. 60/644,609; U.S. Ser. No. 60/644,516; U.S. Ser. No. 60/644,547; U.S. Ser. No. 60/644,638; U.S. Ser. No. 60/644,537; U.S. Ser. No. 60/644,637; U.S. Ser. No. 60/644,719; U.S. Ser. No. 60/644,784; U.S. Ser. No. 60/644,687, each of which is herein incorporated by reference in its entirety.

INCORPORATION BY REFERENCE

The contents of the following U.S. patents are incorporated by reference by their entirety: U.S. Pat. Nos. 4,816,974; 4,947,303; 5,161,883; 5,600,537; 5,816,691; 5,856,721; 6,036,338.

The contents of co-owned, U.S. Ser. No. 10/785,867 (published application US 2005/0184681), issued as U.S. Pat. No. 7,176,635 on Feb. 13, 2007, is incorporated by reference in its entirety.

BACKGROUND OF THE INVENTION

A. Field of the Invention

The present invention relates to retrofitting existing lighting systems with a circuit and method of operation that can compositely illuminate a target area energy-efficiently, with reduced glare and spill light, and with the capability to lower capital and/or operating costs. One primary example is illumination of a sports field.

B. Problems in the Art

Economics plays a big part in most sports lighting. Prime sports lighting customers include entities such as school districts, municipal recreation departments, and private sports leagues. Such entities are particularly sensitive to cost. It would be easier, of course, to meet light quantity and uniformity specifications for a field if one hundred light fixtures on ten poles were erected. The lighting designer could make sure that more than required light is supplied to the field and the volume of space above the field. However, the cost would be prohibitive for most customers. As sports lighting is not usually a necessity, it likely would not be purchased.

Therefore, substantial efforts have gone into reducing sport lighting system costs. One approach is to minimize the number of light fixtures needed to adequately illuminate a target field. Computer programs have been developed towards this end. Programming can optimize the lighting to, in turn, minimize the number of poles and fixtures to meet lighting specifications for an application. Normally, the less light fixtures needed results in lower costs for fixtures but also in lower costs for the poles to elevate the fixtures.

Additional efforts have gone towards developing increasingly more powerful lamps for sports lighting. However, while producing more lumen output, they require more electrical power to operate. More light per fixture may reduce the number of fixtures and poles, but would increase the amount of electrical energy per fixture used. A typical sports light may be used only a couple of hours a day, on average. Several decades, at least, is the expected life of a sports lighting system. Therefore, energy costs become significant, particularly over those lengths of time.

In recent times, sports lighting has also had to deal with the issue of glare and spill light. For example, if light travels outside the area of the sports field, it can spill onto residential houses near the sports field. Also, the high intensity of the lamps can cause glare to such homeowner or create safety issues for drivers on nearby roads. Some communities have enacted laws regulating how much glare or spill light can be caused by sports lighting or other wide-area outdoors lighting. While a number of attempted remedies exist, many result in blocking, absorbing, or otherwise reducing the amount of light going to the field. This can not only increase cost of the lighting system because of the glare or spill control measures, but in some cases requires additional fixtures to meet minimum light quantity and uniformity specifications. More cost might therefore be incurred, to make up for the light lost in glare and spill control measures. In some cases, it can even require more costly and/or additional poles to support the additional fixtures.

Therefore, competing interests and issues provide challenges to sports lighting designers. Some of the interests and issues can be at odds with one another. For example, the need always remains for more economical sports lighting. On the other hand, glare and spill control can actually add cost and/or reduce the amount of light available to light the field. Designers have to balance a number of factors, for example, cost, durability, size, weight, wind load, longevity, and maintenance issues, to name a few. Attempts to advance the art have mainly focused on discrete aspects of sports lighting. For example, computerized design of lighting systems tends to minimize hardware costs and system installation costs but uses conventional lamp and fixture technology, with their weaknesses. Also, larger lumen output lamps produce more light, but are used with conventional fixture technology. A need, therefore, still exists for advancement in the art of sports lighting.

While there are ways to try to improve performance of sports lighting systems when manufacturing new systems, there are millions of light fixtures in presently operating lighting systems all over the world. There is a real need in the art for the ability to economically and efficiently retrofit existing lighting fixtures and systems to improve their performance.

SUMMARY OF THE INVENTION

A. Objects, Features, or Advantages, of the Invention

It is therefore a principal object, feature, or advantage of the present invention to present a high intensity lighting fixture, its method of use, and its incorporation into a lighting system, which improves over or solves certain problems and deficiencies in the art.

Other objects, features, or advantages of the present invention include such a fixture, method, or system which can accomplish one or more of the following:

a) provide economical, retrofittable operating methodologies to both reduce operating costs and increase lamp life for each fixture;

b) improve operating characteristics of a fixture by an economical, retrofittable apparatus to the fixture;

c) can reduce total costs of a system for a given field, but even if total cost is increased, offsets, or exceeds the difference in cost through reduction of energy use;

d) is robust and durable for most sports lighting or other typical applications for high intensity light fixtures of this type, whether outside or indoors;

e) can extend operating life of some components of the fixture;

f) can reduce glare and spill light relative a target space or area.

B. Exemplary Aspects of the Invention

An aspect of the invention comprises a method and apparatus for retrofitting a previously installed wide area HID lighting fixture or fixtures with a system for supplying electrical energy to the arc lamp so that, over operational life of the arc lamp, energy usage is reduced. The method comprises operating the retrofitted system so that the arc lamp is operated at a lowered wattage than normally indicated for the lamp or lighting application, but not so low that it produces unacceptable amounts of light for the given application or substantially affects light characteristics or risk of lamp failure or damage. Operation at the lowered wattage is for a substantial part of the operation of the arc lamp. Over time, usually thousands of hours of lamp life, this can cumulatively represent a substantial savings in energy usage and cost.

In another aspect of the invention, the energy to operate the lamp is reduced substantially but not enough to materially affect either characteristics or jeopardize life of the lamp, but at some later time in operational life, the amount of electrical energy to the lamp during operation is increased to compensate at least partially for lumen depreciation that occur in such arc lamps over time of operation. The increase in electrical energy is selected such that cumulatively the amount of electrical energy used over a good portion of the life of the lamp is still less than what conventionally would be used so that a net energy savings is realized. Length of operational life of the lamp can also sometimes be materially increased.

Another aspect of the invention, an apparatus, method, and system are provided which materially reduce glare or spill light from one or a plurality of fixtures for a given application or target space.

These and other objects, features, advantages and aspects of the present invention will become more apparent with reference to the accompanying specification and claims.

DETAILED DESCRIPTION OF EXEMPLARY EMBODIMENTS

A. Exemplary Apparatus

Published Application US 2005/0184681 filed Feb. 24, 2004, now U.S. Pat. No. 7,176,635, by the owner of this application, describes a sports lighting system and method for changing the way sports lights are traditionally operated. Called the SMART LAMP™, it describes operating the arc lamp at lower than rated wattage during a first period of operating life of the arc lamp, but at a later time increasing operating wattage. The advantages of such a system are described in that published application. Those advantages can be relatively easily and economically added to existing lighting systems that do not have the system.

1. SMART LAMP™ Circuit

Figure 1A:
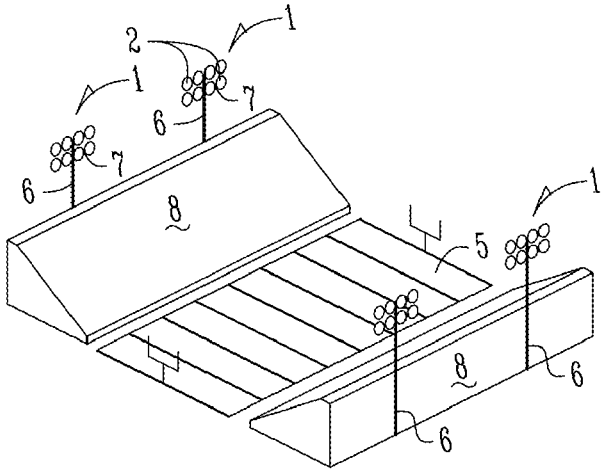
FIG. 1A and its sub-parts B-G illustrate generally a sports lighting system, and conventional components for a sports lighting system.
Figure 1B:
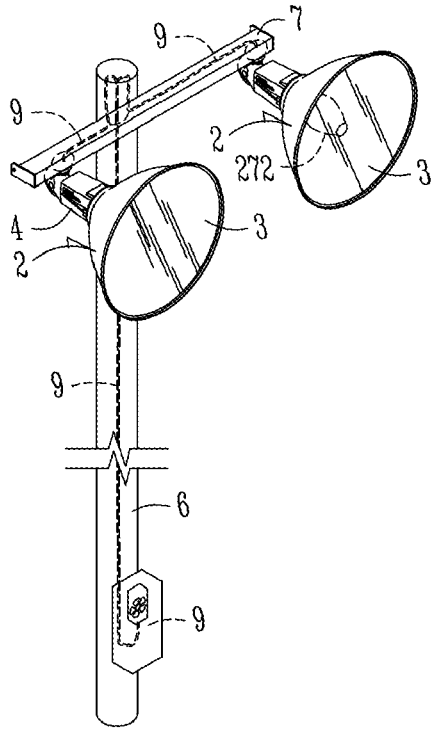
Figure 1C:
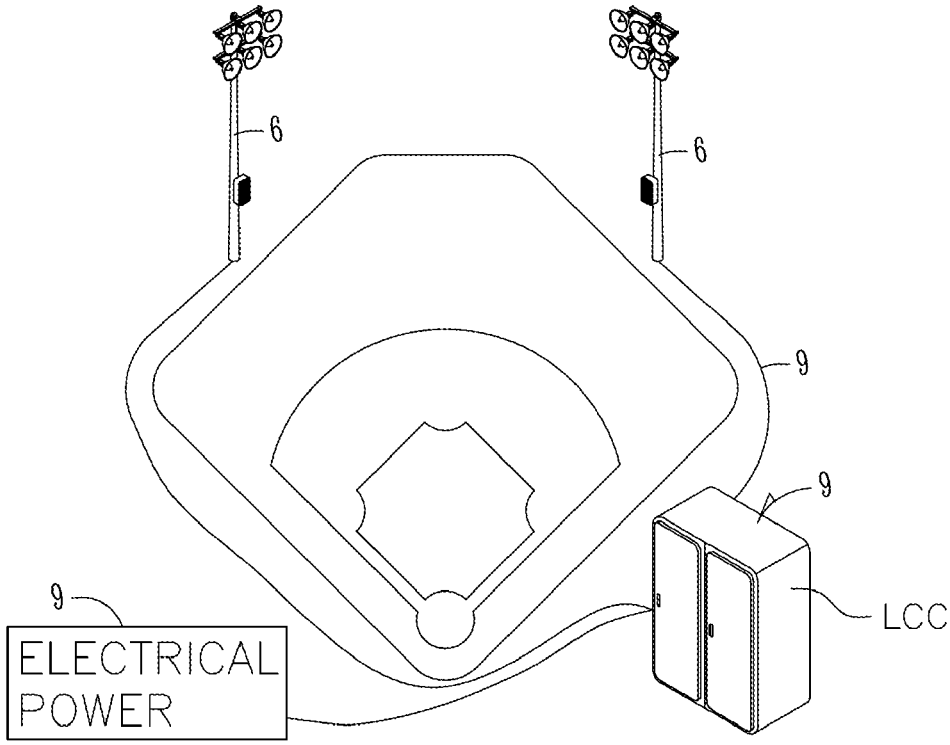
Figure 1D:
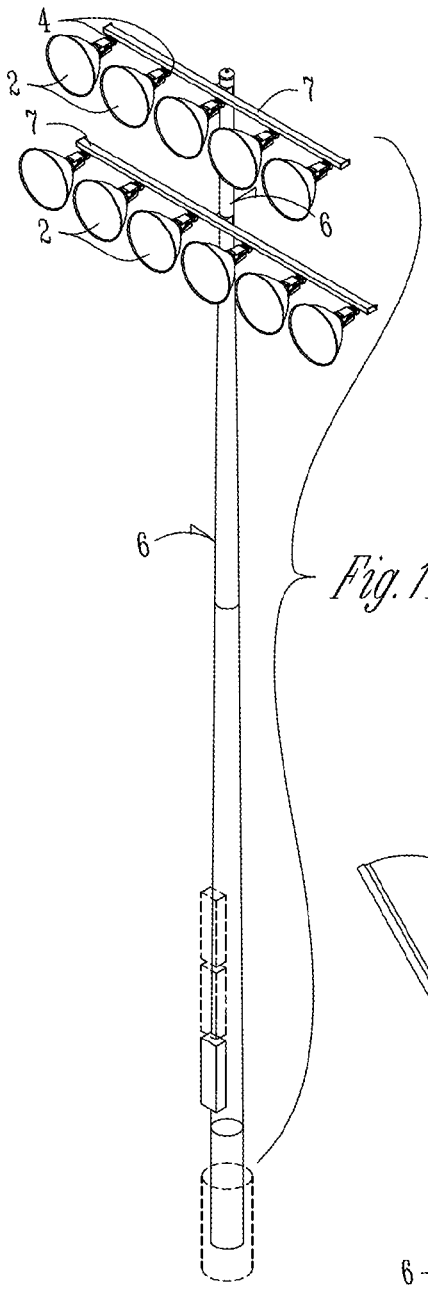
Figure 1G:
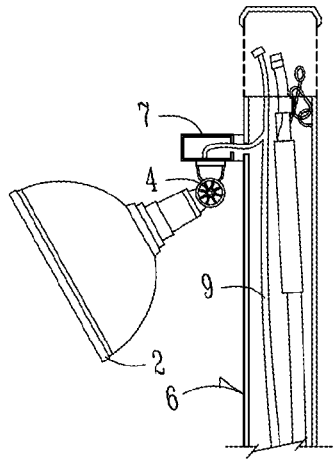
Figure 1E:
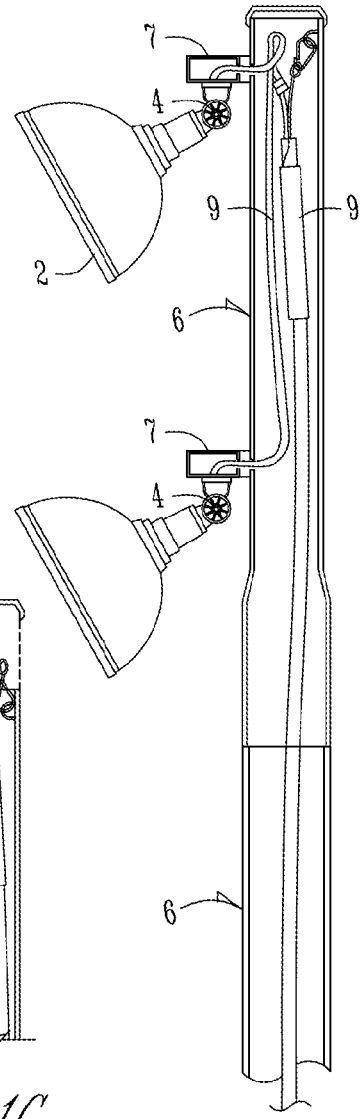
Figure 1F:
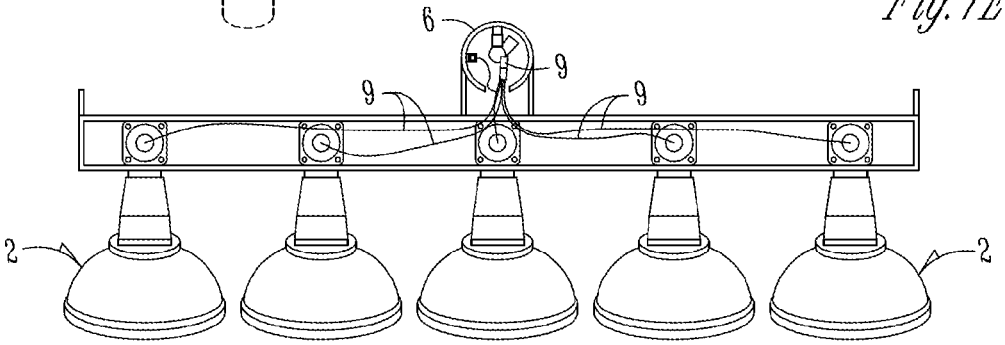
Figure 2:
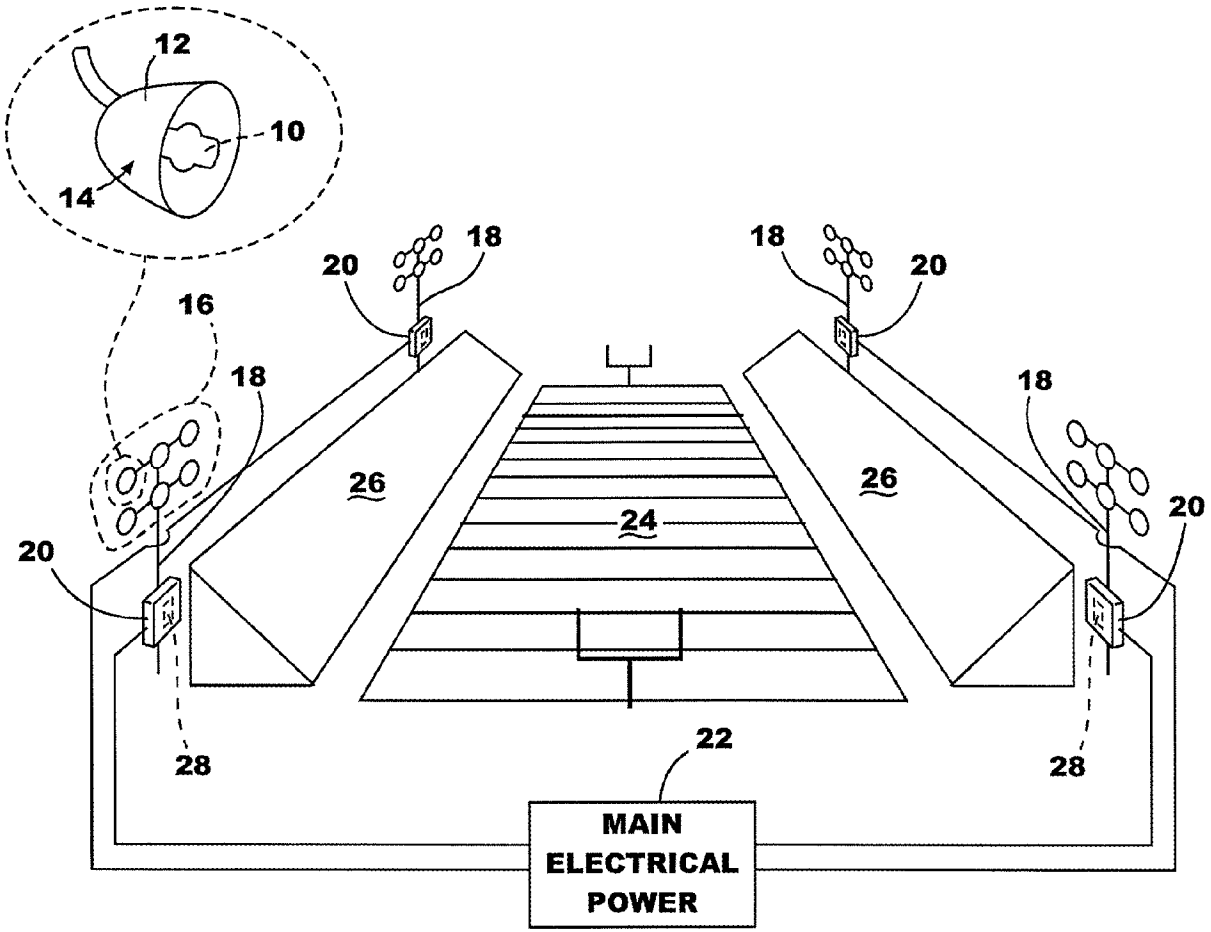
FIG. 2 illustrates a conventional sports lighting system (see now U.S. Pat. No. 7,176,635 incorporated by reference herein)
Figure 3:
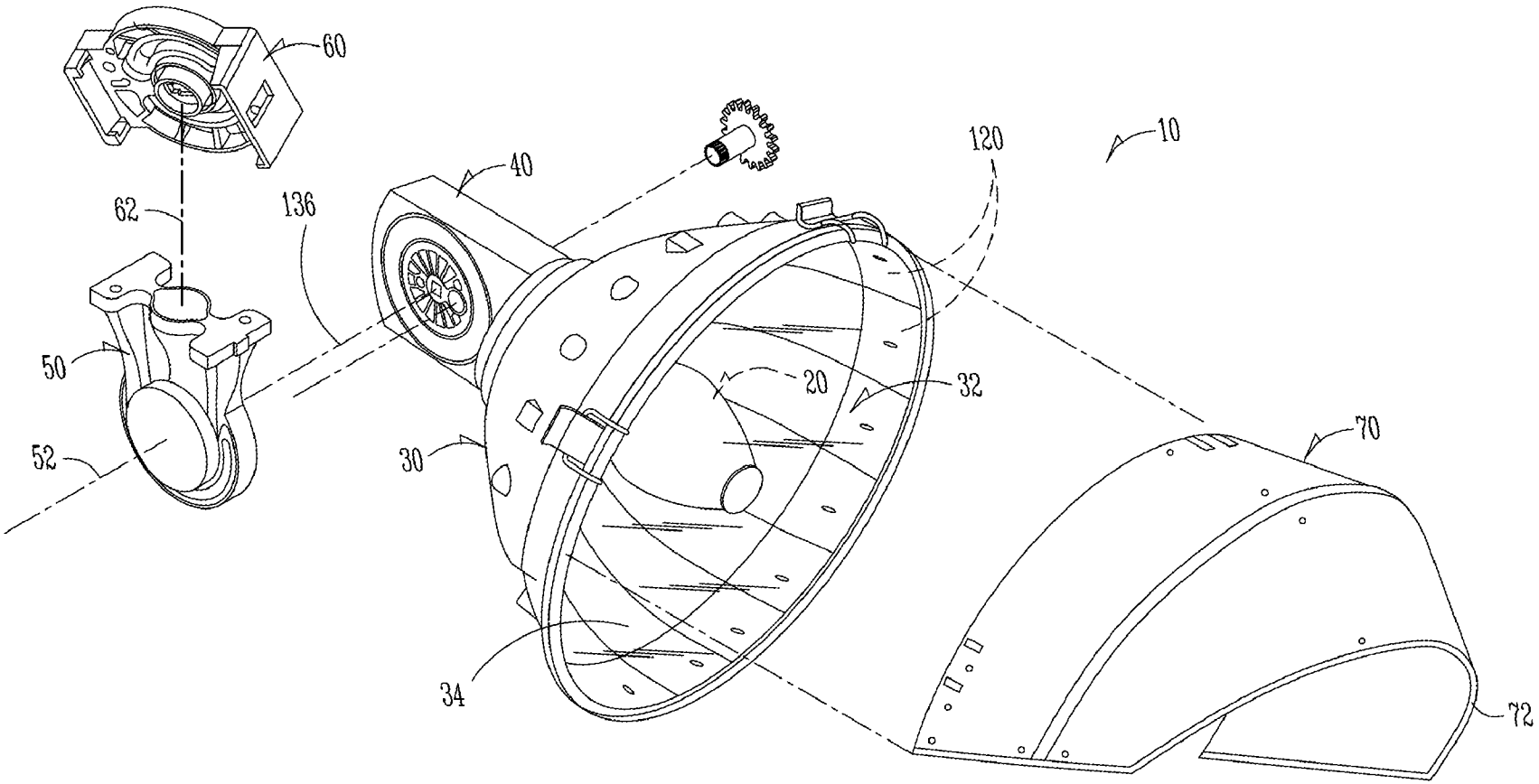
FIG. 3 illustrates an exemplary lighting system.
Figure 4:
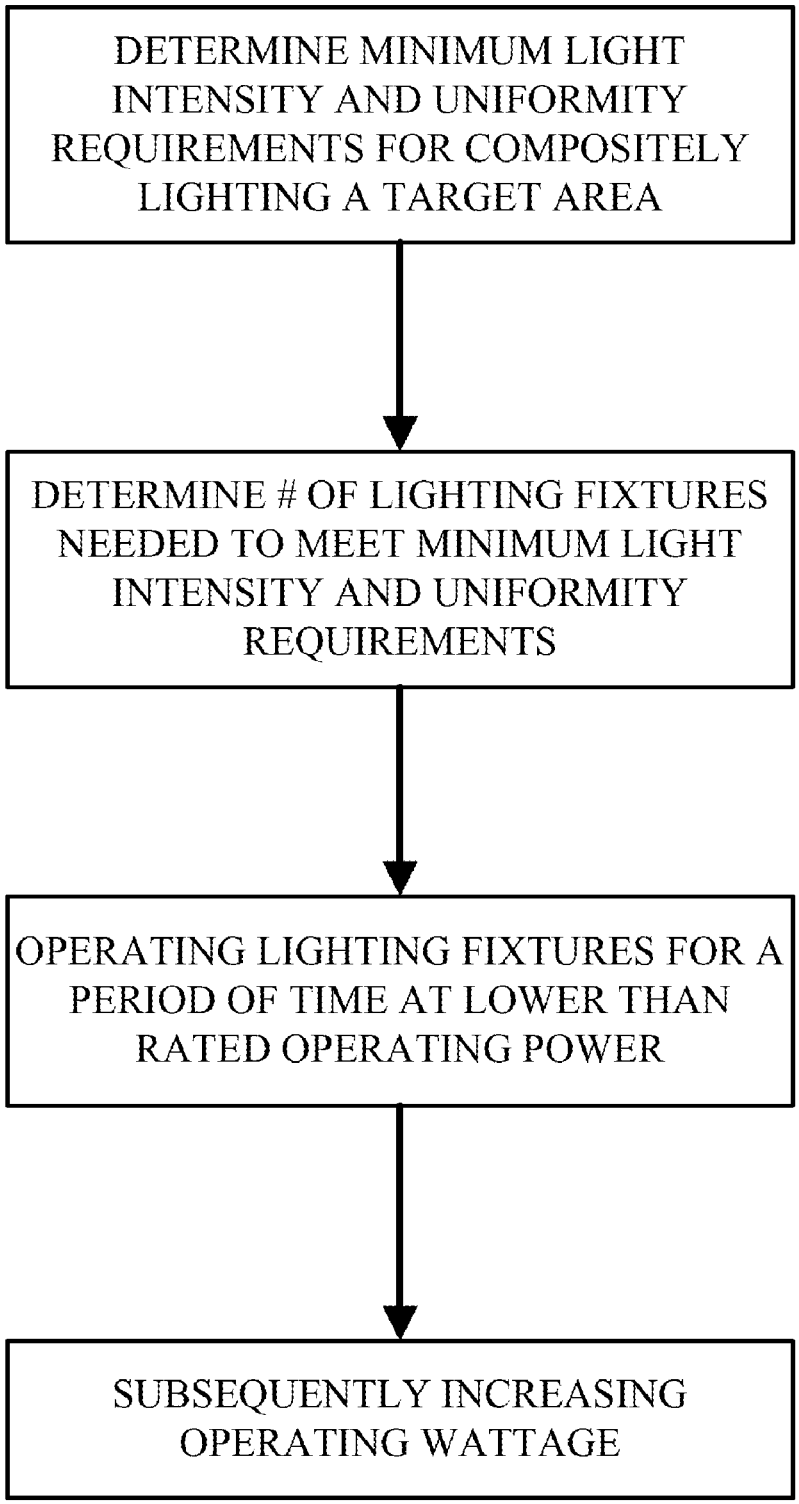
FIG. 4 is a flow chart according to an exemplary embodiment of the present invention.

A circuit of the type in the published application US 2005/0184681, is added to operate lamp 20 of fixture 10 illustrated in FIG. 3. A Smart Lamp™ circuit with linear reactor ballasts, is either in place, or placed in each ballast box for each pole, with appropriate capacitors. The timer for each circuit is set.

As described in US 2005/0184681, significant energy can be saved over operational life of the lamp. It can also extend lamp life. Although adding some additional cost to fixture 10, it is recovered through energy savings. Details regarding SMART LAMP™ are set forth in US 2005/0184681, and are incorporated by reference herein. The SMART LAMP™ circuitry applies a lower wattage to lamp 20 during a period of its operation. Less energy is consumed than if operated at higher wattage. As the lamp ages, lumen depreciation drops lumen output of the lamp. The SMART LAMP™ circuit can switch in more capacitance to the lamp circuit at a selected time to increase lamp wattage (and thus increase lumen output) to combat the lumen depreciation. If wattage is kept below normal for extended periods of time (hundreds or even thousands of hours), energy savings will accumulate and can exceed costs of the circuitry. A lead peak ballast or autotransformer with plural taps could be used with switchable capacitors towards this end. Alternatives include a linear reactor ballast, such as described above. Other methods are possible.

One option would be to allow manual selection of this feature. A manually selectable switch could have "full power" and "energy savings" positions; the latter running the lamp with the SMART LAMP™ energy saving circuit, the former switching out the SMART LAMP™ energy saving circuit. The user could then select between energy savings and higher present light output from the fixture.

Still further, as can be appreciated, existing lighting systems could be retrofitted with the SMART LAMP™ circuit to achieve energy savings and longer lamp life. Old capacitors could be replaced with new ones and the SMART LAMP™ circuit merely plugged in the ballast box. The added cost could be recovered with energy savings.

Also, most of the cost of replacement of lamps is labor and equipment costs. Lamps cost around $30 to $60. Labor and equipment (e.g. a rented crane to elevate a worker to change a lamp) can cost on the order of $120 per lamp change. If lamp life could be lengthened, perhaps by at least double, the cost of at least one lamp change would also by saved, making the retrofit of the SMART LAMP™ circuit additionally economical. Another idea is to retrofit a whole new fixture 10, with SMART LAMP™ circuitry, for a conventional fixture and lamp circuit. Presently the entire fixture 10 may cost in the $300 range. With respect to FIG. 3, it is relatively quick and easy to put knuckle plates 60 on the old cross arms (as in FIGS. 1A-G) and connect knuckle 50 of new fixture 10. The aiming diagrams are usually saved for the lighting installation (either by the owner of the lighting system, its manufacturer, or the installing contractor). To retrofit, the capacitors for the old fixtures are removed from the ballast box, and new ones put in with a SMART LAMP™ circuit. Because the modified lamp 20 in new fixture 10 is operated at a lower wattage with the SMART LAMP™ circuit, the new fixtures may have to be re-aimed. But such costs, as well as the cost to replace the fixtures, can be recoverable because (a) there likely will be less total fixtures needed because of increased light from each fixture 10, and (b) because of energy savings and less lamp changes, with the added environmental benefits of less energy usage, more efficient energy usage, and less spill and glare.

Alternatively, the retrofitting project could leave the same number of fixtures but operate them at a reduced wattage (1500 Watt to 1000 Watt). A one-to-one take out and replacement would just require different capacitors and a SMART LAMP™ circuit, and would be cheaper than changing over all the fixtures to new fixtures 10. There likely would be no re-aiming, but would operate more fixtures.

An additional benefit of this SMART LAMP™ feature is the substantial reduction of glare and spill light in most applications. Less light initially is issued (e.g. approximately 30%) from each fixture 10 using the feature. Therefore, if two fixtures had generally the same light pattern relative a target area, a fixture with the SMART LAMP™ feature would generally create a reduced level of glare and spill light compared to one without during the initial reduced wattage period, because it is outputting less light energy. While SMART LAMP™ generally keeps light output at about the same level during operating life of the lamp, if the 0.7 multiplier reduction in initial light output is used, this represents a significant reduction in spill and glare initially. Conventional systems can have on the order of 50 to 60% more spill and glare during this period. This is with the added benefit that less electricity is used during this time.

This can be a significant issue, especially for lighting systems near neighborhoods or in cities. This can be an environmental issue. Some regulations or rules for glare and spill impose maximum light levels at a neighboring property line. These restrictions can apply from the moment the lighting system is turned on. Therefore conventional systems, with higher initial light output (and higher spill and glare initially) would either have to apply more and expensive spill and glare equipment to the fixtures, but this frequently would result in insufficient light levels at the field once the initial lumen depreciation period for those lamps is done. Therefore, those systems frequently must build-in more light fixtures to the lighting system, which adds cost to the system. It may even require more or more expensive light poles to handle the additional fixtures, which is a still further added cost.

Thus, this SMART LAMP™ feature can provide glare and spill light benefits as well as energy optimization and light output options and benefits. The system designer and end user can balance different options. The SMART LAMP™ is programmable or configurable for different needs and desires. It can produce different performance options. For example, it can produce a range of light outputs. It can produce different regimens of energy savings. The designer and end user can select from and balance different factors and customize the benefits to each application.

As can be seen, one benefit to the end user can be a reduction in the fixture count for a lighting system. The lower initial spill and glare but maintenance of light levels over operation life, can allow less fixtures to light the field. This reduces capital cost, and usually operating costs. It can reduce cost further by requiring fewer poles or less expensive poles to elevate the reduced fixture count.

What is claimed is:

1. A method for increasing useable light from a high intensity lighting fixture to a target area without an increase in energy use, the lighting fixture including a lamp with an arc tube substantially surrounded by a reflecting surface and a glass lens to produce a controlled, concentrated beam that is generally converging in nature from the fixture, comprising:

a. retrofitting a circuit that allows variable operating wattage to the lamp; and b. selectively operating the lamp at a reduced wattage over a substantial period of operation time to save energy.

2. The method of claim 1 wherein the period of time is hundreds of hours.

3. The method of claim 1 further comprising raising the operating wattage at a point of time in the period to counteract lamp lumen depreciation, but maintain cumulative energy savings for the entire operating period.

4. The method of claim 3 further comprising a plurality of increases of operating wattage at substantially spaced apart times to combat lamp lumen depreciation, but maintain cumulative energy savings for the entire operating period.

5. The method of claim 1 wherein the circuit comprises:

a. switchable capacitance in electrical communication with the lamp, one switchable capacitance adapted for operating the lamp at a reduced wattage over a substantial period of operation time to save energy.

6. The method of claim 5 wherein another switchable capacitance is adapted for operating the lamp at a higher wattage to counteract lamp lumen depreciation, but maintain cumulative energy savings for the entire operating period.

7. The method of claim 6 further comprising a plurality of switchable capacitances adapted to increase operating wattage of the lamp at substantially spaced apart times to combat lamp lumen depreciation, but maintain cumulative energy savings for the entire operating period.

8. A method for increasing useable light from a high intensity lighting fixture to a target area without an increase in energy use, the lighting fixture including a lamp with an arc tube substantially surrounded by a reflecting surface and a glass lens to produce a controlled, concentrated beam that is generally converging in nature from the fixture, comprising:

a. retrofitting a circuit that allows variable operating wattage to the lamp;

b. selectively operating the lamp at an increased wattage over a period of operation time.

9. The method of claim 8 wherein the period of operation time is much less than hundreds of hours.

10. The method of claim 8 further comprising selectively operating the lamp at a reduced wattage over a period of operation time.

11. The method of claim 10 wherein the period of operation time at a reduced wattage comprises hundreds of hours.

12. The method of claim 8 wherein the circuit comprises a switchable capacitance in electrical communication with the lamp, one switchable capacitance adapted for operating the lamp at a reduced wattage over a substantial period of operation time to save energy.

13. The method of claim 12 wherein another switchable capacitance is adapted for operating the lamp at a higher wattage to counteract lamp lumen depreciation, but maintain cumulative energy savings for the entire operating period.

14. The method of claim 13 further comprising a plurality of switchable capacitances adapted to increase operating wattage of the lamp at substantially spaced apart times to combat lamp lumen depreciation, but maintain cumulative energy savings for the entire operating period.

15. A method for increasing useable light from a plurality of high intensity lighting fixtures to a target area without an increase in energy use, each lighting fixture including a lamp with an arc tube substantially surrounded by a reflecting surface and a glass lens to produce a controlled, concentrated beam that is generally converging in nature from the fixture, comprising:

a. retrofitting a circuit that allows variable operating wattage to one or more of the lamps;

b. selectively operating the said lamps at a reduced wattage over a substantial period of operation time to save energy at a reduced wattage.

16. The method of claim 15 further comprising a plurality of arrays of said plural high intensity lighting fixtures, each with a retrofitted said circuit.

17. The method of claim 16 wherein the plurality of arrays are adapted to illuminate a portion of said target area.

* * * * *